US007524273B1

(12) United States Patent
Martin

(10) Patent No.: US 7,524,273 B1
(45) Date of Patent: Apr. 28, 2009

(54) PORTABLE REHABILITATION AND EXERCISE EQUIPMENT

(76) Inventor: Nathan C. Martin, 1845 Federal Ave., #2, Los Angeles, CA (US) 90025

( * ) Notice: Subject to any disclaimer, the term of this patent is extended or adjusted under 35 U.S.C. 154(b) by 845 days.

(21) Appl. No.: 10/767,155

(22) Filed: Jan. 28, 2004

(51) Int. Cl.
*A63B 21/00* (2006.01)

(52) U.S. Cl. ..... 482/142; 482/130; 482/121

(58) Field of Classification Search ..... 482/121, 482/122, 126, 129, 142, 140, 130, 132
See application file for complete search history.

(56) References Cited

U.S. PATENT DOCUMENTS 5,080,353 A * 1/1992 Tench ..... 482/130
5,871,425 A * 2/1999 Gvoich ..... 482/140

* cited by examiner

*Primary Examiner*—Jerome Donnelly
(74) *Attorney, Agent, or Firm*—Wagner, Anderson & Bright, LLP; Roy L Anderson

(57) ABSTRACT

An exercise system uses a definable planar platform surface on which an exercise mat can be placed, multiple resistance tubings with attachment mechanisms at each end, a pair of grips that can be attached to resistance tubings, a pair of anklet bracelets that can be attached to resistance tubings, and three pipes detachably affixable to the platform surface. Each pipe has its own attachment device for allowing one or two of the resistance tubings to be attached. The three pipes are arranged such that one is centrally located at one lengthwise end of the platform while the other two are spaced apart and substantially equidistant from the other lengthwise end of the platform. The platform and the exercise mat can be made of two parts foldable 180 degrees from each other. The two pipes located at one lengthwise end of the platform are preferably spaced apart at least the shoulder width of a user and have their attachment mechanisms located approximately ten inches from the platform. The pipe centrally located has its attachment mechanism locatable approximately four feet from the platform surface.

11 Claims, 4 Drawing Sheets

PORTABLE REHABILITATION AND EXERCISE EQUIPMENT

FIELD OF THE INVENTION

The present invention is in the field of equipment that can be used for rehabilitation and exercise programs.

BACKGROUND OF THE INVENTION

Pilates is currently a hot topic in the field of personal training, rehabilitation and personal fitness. It has achieved widespread notoriety and press. Stars and athletes extol its virtue. Stories abound about the rehabilitative benefits associated with different Pilates routines and exercise. Pilates equipment and trainers are seemingly everywhere, and it appears there is more demand for Pilates trainers than there are qualified trainers. So, what exactly is all the commotion about, especially if one is not already familiar with Pilates?

A brief search on the Internet reveals various manufacturers of Pilates equipment, certification agencies, books on Pilates, Pilates exercise video programs and many different sites talking about Pilates, and how Pilates instructors can help one in Pilates exercise programs. In fact, there is really somewhat of a bewildering array of material, but little authoritative summary material, except for very concise statements that are too general to be of much use in really answering the question of, what exactly is Pilates?

The following discussion of Pilates is based upon the book The Everything Pilates Book, published by Adams Media Corporation, ISBN: 1-58062-738-2, copyright 2002, the disclosure of which is specifically incorporated herein by reference. The book provides an historical look at Pilates, and the role of key people in its early development. It also discusses the fundamental skills of Pilates and provides a very useful, broad-based discussion of Pilates. In the following discussion, there are quotes from the third chapter of this book entitled "The Fundamentals of Pilates" as well as from the sixth chapter entitled "Pilates Equipment."

German-born fitness innovator Joseph H. Pilates (1881-1967) developed the Pilates exercise system in the 1920s. His interest in physical fitness stemmed from a determination to strengthen his own body and improve his health after a sickly childhood. With a diverse background of experience, Joseph Pilates devised a unique sequence of movements that worked the mind and muscle in harmony.

Joseph Pilates and his wife opened a studio in New York City in 1926. The studio trained and helped rehabilitate a number of dancers, and became the fitness center for a number of New York City's richest and most influential citizens. The studio remained open, and was run by Joseph Pilates or his wife, until 1971. During that time, the Pilates name was associated with Joseph Pilates and his studio, and he invented a number of different pieces of equipment used in his exercise training programs. After the death of Joseph Pilates and his wife, a dispute arose concerning the name Pilates, and it was eventually decided, in a federal court, that the name Pilates refers to an exercise technique and that it could not serve as a trademark. Now, the name Pilates is associated with a variety of exercise programs, techniques and equipment pioneered by Joseph Pilates, but also with the philosophy he espoused.

There are several variations of Pilates principles today, ranging from those that Joseph Pilates pioneered in the early 1900s to contemporary adaptations that incorporate modern understanding of fitness, anatomy and biomechanics.

Joseph Pilates developed his fitness method with one overriding goal: to give people a way to achieve "true health." He defined true health as "the attainment and maintenance of a uniformly developed body" with a well-balance "holy trinity" of body, mind, and spirit. Fundamental goals of Pilates are uniform development, deep healthy breathing, flexible and decompressed spine and joints, robust circulation, and the trinity of body/mind/spirit.

Concentration and awareness are like the macro and micro focus functions of a single lens. You need both to be able to concentrate on the specifics and to be aware of the whole. Concentration enables one to make precise controlled movements. To do any Pilates movement or exercise correctly, one must be able to focus one's attention and intense concentration on certain body parts or specific skills. Every movement matters.

Joseph Pilates designated the area of the torso between the lower ribs and hips as the "Powerhouse" or center. He believed that correctly developing this area of the body is crucial to mastering his method of body conditioning, and thereby achieving health. A strong Powerhouse forms the foundation for all Pilates movements; energy emanates from the center and flows outward toward your hands and feet. This principle is referred to as "centering."

Every Pilates exercise is made up of a series of smooth, fluid movements; you should never see a Pilates student strain or jerk to achieve a correct position or movement. The whole-body approach of Pilates fosters connected, graceful, natural movement.

When you do Pilates, you don't stop and start and you don't move too quickly or too slowly. You maintain a strong, controlled pace that takes you smoothly through the process of on movement and on to the next. And you carefully coordinate all of your movements with your breathing, to give them even more grace, strength, and connected flow.

Oppositional energy is a principle that combines the sills of concentration and visualization to increase the benefits of movement. Using this principle, you visualize that two opposing points in your body are actually stretching apart as you assume a position or movement, and your muscles react to that visualization by exerting energy in opposing directions. You "think" the stretch, then your muscles respond to your thought.

Oppositional energy helps your body refine its physical placement and creates elongation by giving your muscles and joints a mental roadmap. In Pilates, you use oppositional energy to elongate your spine and decompress all joints—an important goal. Oppositional energy elongates muscles, aligns bones, and balances and stabilizes the muscular forces around each joint. It also gives muscles a deeper workout by adding internal resistance to each muscle group's load.

Oppositional energy helps work all muscle groups simultaneously, by engaging both the muscles used for lengthening, and the opposing muscles used to stabilize or resist that pull. For instance, to lengthen and properly position your leg while keeping your pelvis square and stable, you don't want to just push out with your foot. That action might pull your pelvis forward and tilt your body position. Instead, visualize that your hip and heel are actually pulling apart with oppositional energy. This visualization helps you accomplish the stretch without destabilizing the position of your pelvis.

Proper breathing guides everything else you do in your Pilates training. To breathe properly during Pilates exercises, you need to fill your lung completely—expanding them to their greatest capacity—and then empty the lungs of all air.

Pilates is not a bodybuilder's workout, designed to bulk up specific muscles. Pilates is a condition program designed to work the whole body simultaneously and uniformly. Joseph Pilates created his exercises with the intention "that each muscle may cooperatively and loyally aid in the uniform development of all our muscles. Developing minor muscles naturally helps to strengthen major muscles." As a result, every muscle is developed in every movement.

Pilates works to develop longer, stronger muscles—not just bigger ones. Pilates benefits also extend beyond one's muscles, to develop stronger, more flexible joints, as well. Regular Pilates practice helps one build a strong, flexible, uniformly well-developed body.

The fundamental Pilates workout can be performed on a mat alone, and great results can be achieved through beginner, intermediate and advanced moves. However, Joseph Pilates also invented various equipment pieces, such as the Reformer, that incorporate light spring resistance that works like concentric and eccentric muscle contractions to safely sculpt, tone and stretch the muscles. Smaller Pilates equipment pieces such resistance bands, circles and balls also provide an element of variety and focus to a Pilates regimen.

A complete and satisfying workout can involve exercises on the mat alone or can be combined with various pieces of specially designed Pilates equipment. Each session can offer variety so that no two workouts are alike.

The Universal Reformer is the most widely known piece of Pilates equipment. The Universal Reformers' unique combination of springs, pulleys, straps, and sliding carriage make it an incredibly valuable and useful piece of equipment. Its adjustability enables the Reformer to address a wide range of physical capabilities, disabilities, and fitness goals with refined, sophisticated solutions. Joseph Pilates created nearly 100 exercises on the Reformer—more exercises than he designed for any other piece of Pilates equipment. The Reformer consists of a wooden or metal rectangular frame, approximately seven feet long and two feet wide, resting about 16 inches above the floor on four legs. Interior metal tracks run the length of the frame, providing guidance for a wheeled and padded carriage that attaches to the frame with springs at one end and a handle-and-strap pulley system at the other.

The carriage has a headrest, shoulder blocks, and handgrips. One end of the Reformer frame is equipped with a foot bar and strap, and a series of gears that allow users to adjust the distance between the shoulder blocks and foot bar to accommodate different movements and different body types.

Several accessories are available for the Reformer, including additional straps, support blocks, strap extensions, and so on.

On the Reformer, the student lies, sits, kneels, and stands in many different positions as he or she stretches and extends the body—enabling access to a wide range of movements and, therefore, developing all of the body's muscles simultaneously. Sometimes the student's hands are on the foot bar, sometimes they hold flexible straps or balance on top of the shoulder blocks; or the student's feet can assume any of these positions. In all positions, the spine arches, twists, and flexes as the carriage on which the student's body is positioned moves back and forth.

The Reformer (like most Pilates equipment) differs from traditional fitness equipment in very fundamental ways. Rather than using an isolated set of muscles to move an external forces, such as a barbell or stack of weights, you use your Powerhouse to lift and pull your body's weight along with the Reformer's spring-loaded carriage. This action automatically centers you, developing balance, coordination, and body/space awareness as it strengthens and stretches your entire body, not just any one isolated set of muscles.

As with all of his equipment, Joseph Pilates continually experimented and advanced his theories and designs for the Reformer. As a result, he built many versions of the Reformer during his lifetime. Since his death, the Reformer has become the most adapted piece of equipment in the Pilates studio.

Many changes to the original Reformer design have benefited neither the client nor the method; often, the meddlers had little understanding of Pilates' original vision. Differences in dimensions, for instance, alter certain exercises dramatically enough to make them less valuable, sometimes impossible, and, in the worst cases, even dangerous. Further complication matters, some instructors and Pilates facilities teach only the Reformer exercises offering instruction in no other part of the Pilates method.

While the Reformer is an excellent piece of equipment to use in Pilates programs, it can be quite expensive and not especially portable. This limits its use primarily to use in studios, as opposed to homes. Also, it prevents the Reformer from being a practical piece of equipment useful in personal Pilates training, even by Pilates professionals, in personal training sessions outside of studios.

There are other pieces of Pilates equipment that do not suffer from the drawback of cost or lack of portability. An example is the Magic Circle. However, in view of the desirability of variety, and a wide range of exercises that can fit within a Pilates training program, there is a very real and continuing widespread need for improved Pilates equipment. Such equipment, to be most useful, should be inexpensive, portable, capable of a wide range of exercises, especially exercises that work on the Powerhouse, and, most importantly, be adapted to fit within a Pilates program.

However, there is also a continuing need for equipment useful in rehabilitation and exercise that goes beyond Pilates equipment or equipment useful in Pilates exercises.

For example, many athletes find it desirable to work with personal trainers who focus on programs that are specifically designed to enhance skills useful in a chose sport. Also, there is always a need for improved devices useful for training professional athletes, or for elite athletes in competitive programs, such as college sports in the United States, or athletes training for specific goals, such as competing in the Olympics. For such professional and elite athletes, even a slight increase in performance can give them a much needed boost in a field of very competitive athletics.

The present invention is directed to a new system of exercise equipment that is extremely useful for rehabilitation or for other training. While it can be used for Pilates-type movements, it can also be used for specified sports training in that an athlete is able to do resistance training while performing movements that closely mimic the actual movements used during the actual performance of that athlete's specific sport. For example, it can be used for exercises specifically geared toward swimming.

In addition, the present invention can perform complimentary exercises that, until now, could not or have not been performed on any other equipment or system. Also, in contrast to traditional exercise machines, the present invention allows muscles to be worked from a flexed position through a full range of motion with resistance increasing through the muscular extension (range of motion) allowing each extremity to be worked individually yet in a manner that is designed to achieve proper muscle symmetry, strength, flexion, and balance throughout the entire body by working the independent extremities simultaneously (e.g., leg extension/hamstring curl movement).

Moreover, the present invention is portable and can be folded up to save space when being stored.

Accordingly, as will be apparent from the description below, the present invention is directed to a truly revolutionary system with many benefits that could not previously be obtained.

SUMMARY OF THE INVENTION

The present invention is generally directed to an exercise system that uses a definable planar platform surface on which an exercise mat can be placed, multiple resistance tubings with attachment mechanisms at each end, a pair of grips that can be attached to resistance tubings, a pair of anklet bracelets that can be attached to resistance tubings, and three pipes that can be affixed to the platform surface, each pipe having its own attachment device for allowing at least one, if not two, of the resistance tubings to be attached. The three pipes are arranged such that one is centrally located at one lengthwise end of the platform while the other two are spaced apart and substantially equidistant from the other lengthwise end of the platform.

In a first, separate group of aspects of the present invention, the platform and the exercise mat are comprised of two parts foldable 180 degrees from each other, the three pipes are removable from the platform and multiple foldable legs allow the platform to be raised off from a surface on which the exercise system is used.

In other, separate aspects of the present invention, the two pipes located at one lengthwise end of the platform are spaced approximately two feet apart, and, even more preferably, spaced apart at least the shoulder width of a user. The first pipe, which is centrally located, has its attachment mechanism locatable approximately four feet from the platform surface whereas the second and third pipes have their attachment mechanisms locatable between approximately six to approximately twelve inches, and preferably approximately ten inches, from the planar platform surface.

In still other, separate aspects of the present invention, the resistance tubings can have approximately the same resistance, or pairs can have different resistance.

Accordingly, it is a primary object of the present invention to provide an improved exercise system that is also useful for rehabilitation.

This and further objects and advantages will be apparent to those skilled in the art in connection with the drawings and the detailed description of the preferred embodiment set forth below.

DETAILED DESCRIPTION OF THE PREFERRED EMBODIMENT

In the preferred embodiment of the present invention, a portable, foldable exercise system is provided that can be adopted for use in a wide variety of exercises an exercise routines, including exercise routines specifically adapted for improving certain athletic movements or skills, as well as some exercises not previously known.

Figure 1:
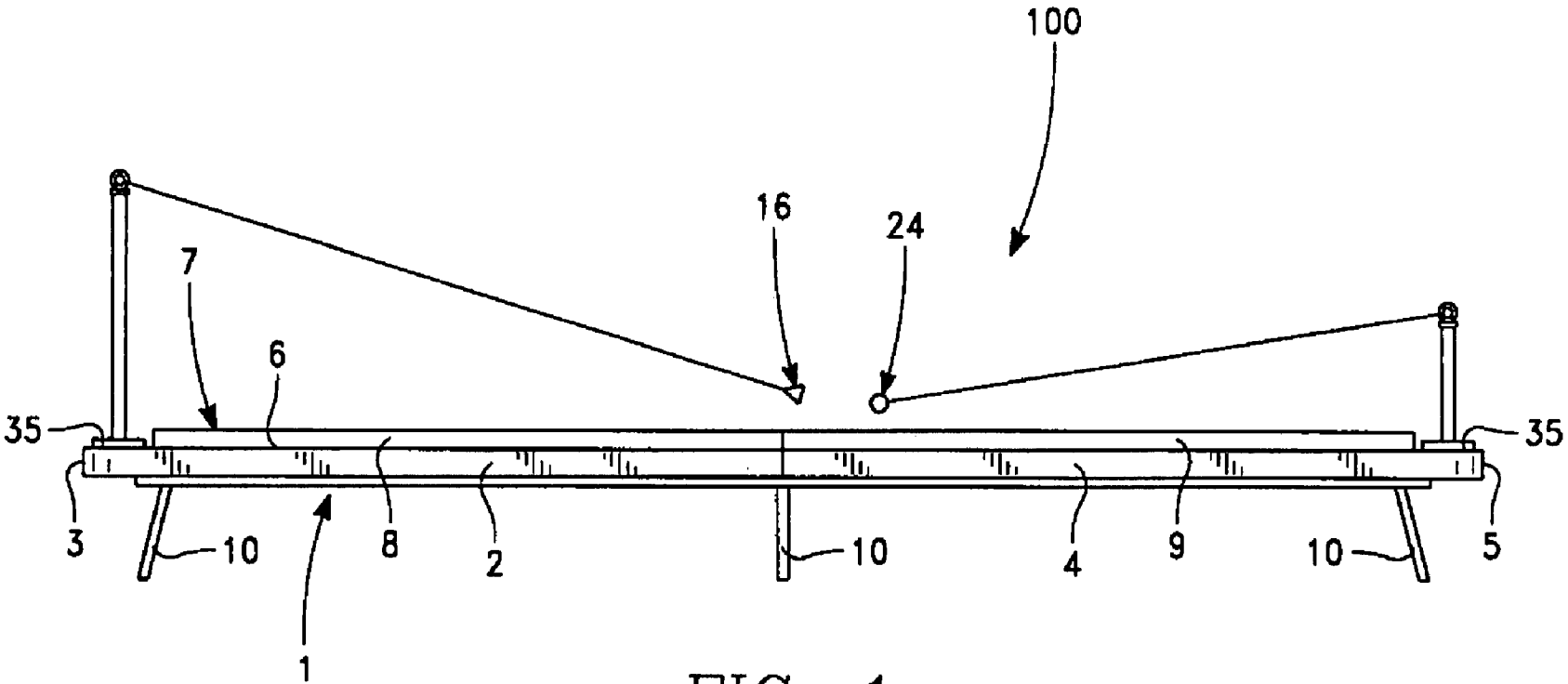
FIG. 1 shows a preferred embodiment of an exercise system in accordance with the present invention from a side view with resistance tubings extended out as if in use.
Figure 2:
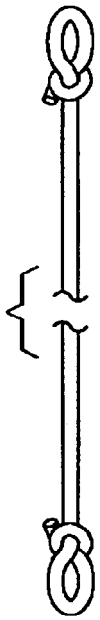
FIG. 2 is a view of a resistance tubing useful in the present invention.
Figure 6:
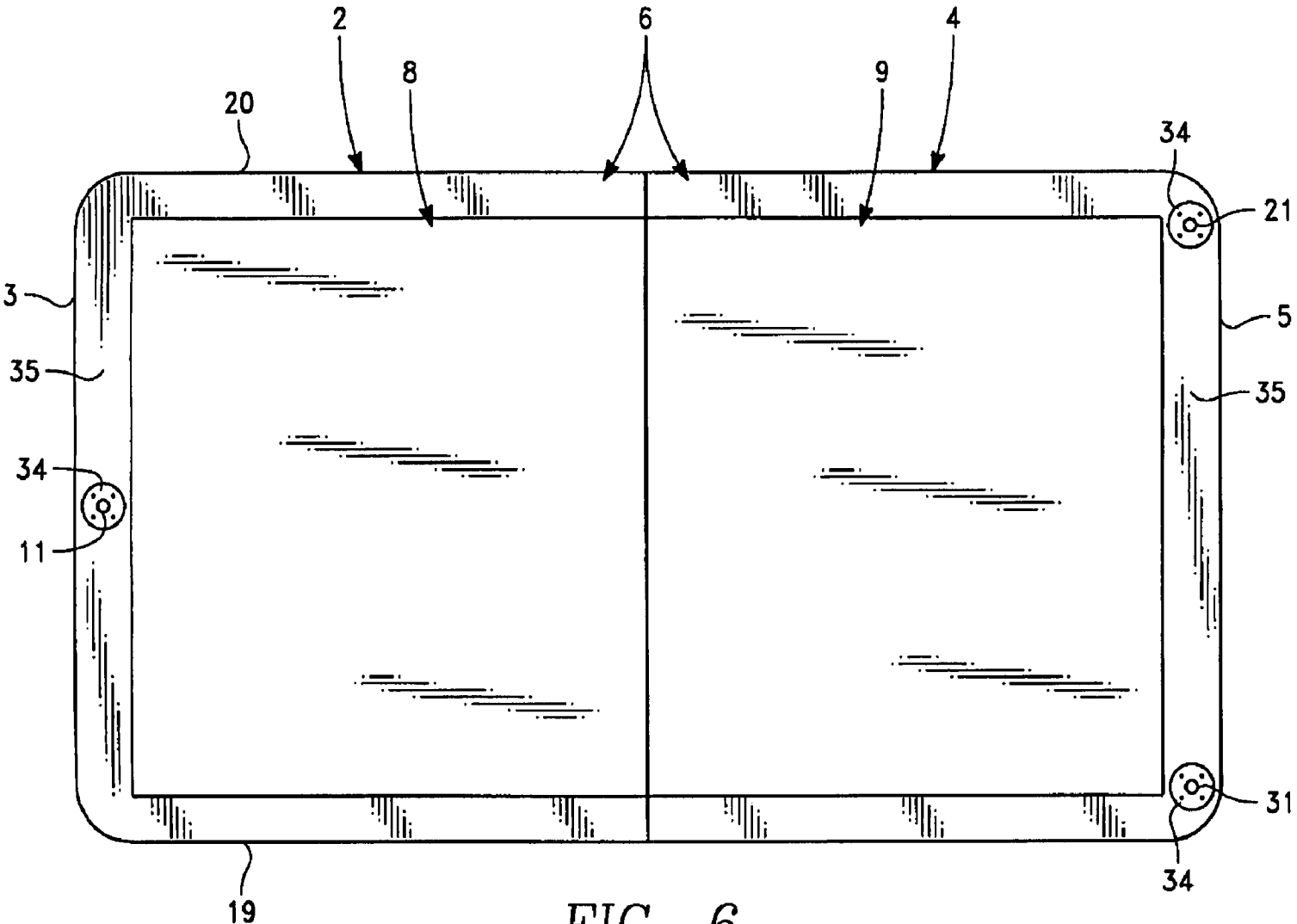
FIG. 6 is a top planar view of the platform of a preferred embodiment of the present invention in a folded flat position.
Figure 7:
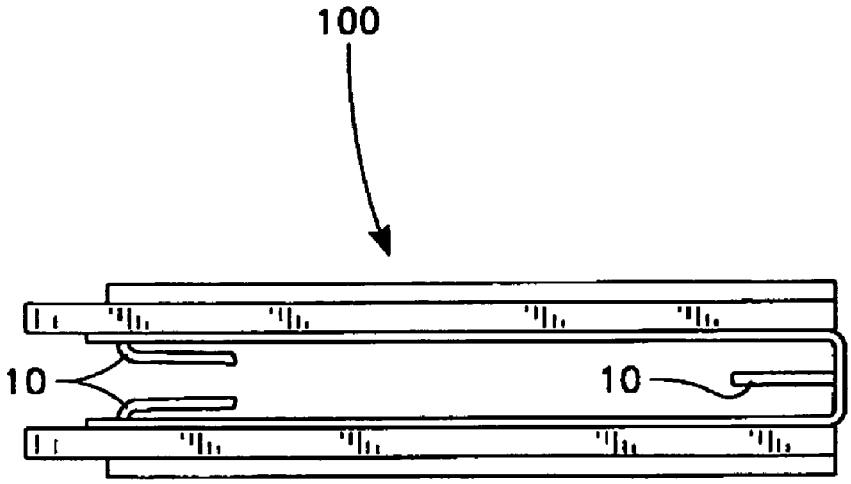
FIG. 7 is a side view of a preferred embodiment of the present invention in a folded position.

As shown in FIGS. 1, 6 and 7, the preferred embodiment is a foldable exercise system 100 that has a foldable, raised platform 1 made from a first foldable platform 2 with a first end 3 and a second foldable platform 4 with a second end 5. It is especially preferred that the surfaces of the first and second foldable platforms 2 and 4 are flat so that they will define a planar platform surface 6 located between the first and second ends 3 and 5 when they are not folded together relative to one another, but that they be foldable substantially 180 degrees relative to each other. Suitable dimensions for each of the first and second foldable platforms 1 and 2, for most usage, would be 28 inches wide by 40 inches long. Platform 1 can be made of any suitable, sturdy material, such as % inch thick birch wood, metal or some other substance, such as Mylar® or a durable, thick plastic.

Multiple, foldable leg supports 10 cause platform 1 to be raised off from a surface on which the exercise system is deployed (e.g., a floor) when the legs are in an extended position and the first and second foldable platforms 2 and 4 lie flat (see FIG. 6) but which are foldable when the first and second foldable platforms 3 and 5 are folded relative to each other (see FIG. 7). An example of suitable foldable leg supports 10 would be an aluminum frame, 24 inches wide, 72 inches long, made out of one inch aluminum tubing, foldable in its middle, similar to folding legs commonly found on foldable tables.

It is especially preferred that platform 1 be raised approximately twelve inches or more from the surface on which it is deployed. This distance allows ease of use in terms of persons getting onto platform 1, but it also allows certain exercises, such as exercises useful for training swimmers, to be performed, where the exercise will require movement below definable platform surface 6.

An exercise mat 7 (e.g., a 2 inch foam padding exercise mat) is attached to the planar platform surface 6. The exercise mat 7 can be constructed so that it has two parts that can fold 180 degrees relative to each other in a stored position, but it is especially preferred that it be constructed of a first mat 8 attached to the first foldable platform 2 and a second mat 9 attached to the second mat 4. Mat 7 can be attached to platform surface 6 by any number of suitable methods. For example, mat 7 could be permanently attached to surface 6 by any number of suitable means (e.g., glue), or it could be removably attached to surface 6 by any number of suitable means (e.g., Velcro™ or other straps).

A first pipe 11 is detachably connected to first foldable platform 2 proximate first end 3 so as to extend perpendicularly upwardly from planar platform surface 6. It is especially preferred that first pipe 11 be centered between horizontal ends 19 and 20 of platform surface 6 (see FIG. 6) as close as reasonably possible to first end 3. First pipe 11 has a first attachment device 12 that can be fixed or movably locatable at least approximately four feet from planar platform surface 6 for enabling attachment mechanisms 14 of a pair of resistance tubings 13 to be attached to first pipe 11.

A second pipe 21 and a third pipe 31 are detachably connected to second foldable platform 4 proximate second end 5 so as to extend perpendicularly upwardly from planar platform surface 6. It is especially preferred that second and third pipes 21 and 31 are substantially equidistant, but as close as reasonably possible, from second end 5 when they are connected to second foldable platform 4, and that they are at least shoulder width apart of a person using exercise system 100. Second pipe 21 has a second attachment device 22 that can be fixed or movably locatable approximately six to twelve inches from planar platform surface 6 for enabling attachment mechanism 14 of a second resistance tubing 23 to be attached to second pipe 21 while third pipe 31 has a third attachment device 32 that can be fixed or movably locatable approximately six to twelve inches from planar platform surface 6 for enabling attachment mechanism 14 of a third resistance tubing 33 to be attached to third pipe 31. When exercise system 100 is in use, second and third attachment devices 22 and 32 should be located equidistant from definable planar platform surface 6.

Figure 3:
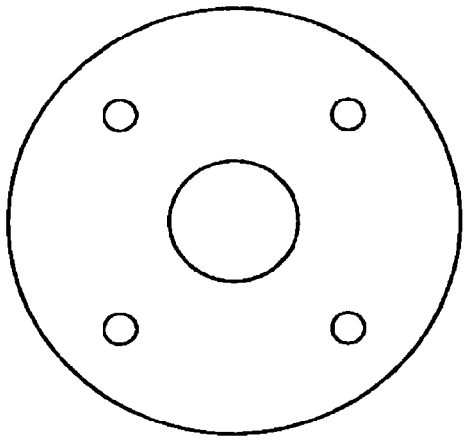
FIG. 3 is a top planar view of a flange for holding pipes used in the preferred embodiment of the present invention.

First, second and third pipes 11, 21 and 31 can be made of ¾ inch pipe that can be screwed into a ¾ inch plumber's flange 34 (FIG. 3) secured by another 3×28 inch board 35 attached to first and second foldable platforms 2 and 4 adjacent to each of first and second ends 3 and 5. While the present invention uses the word "pipe" in its description and its claims, pipe is not meant to be used in a narrow, dictionary sense, such as a hollow, round material. Instead, the word "pipe," as used herein, encompasses both hollow materials or materials that are not solid, as well as solid materials. Also, the definition of "pipe" is not meant to be limited to a circular pattern since many other geometric patterns, such as a triangle, square, pentagon, hexagon, or even some irregular geometric, decorative or ornamental pattern, might suffice. In other words, while circular, hollow pipes are especially preferred, in view of the ease of obtaining such materials for a low cost, any suitable structural element will suffice as long as it meets the functional requirements that are fulfilled by a pipe—to with, a sufficiently sturdy material, extending upwardly from platforms 2 and 4, for locating first, second and third attachment devices 12, 22 and 32 at their appropriate positions away from planar surface 6.

The pair of resistance tubings 11 and second and third resistance tubings 21 and 31 also have a second attachment mechanism 15 at their other end. The exact attachment mechanism used for the first and second attachment mechanism of any of the resistance tubings (e.g., a hook mechanism) is not critical to the present invention and is well within the skill of a person of ordinary skill in the art. Also, while it is especially preferred that each of these resistance tubings be of the same grade of tubing (e.g., regular tubing to provide medium tension sufficient for beginning to intermediate level usage, or advance grade tubing, which can be a difference color, that should provide tension sufficient for advanced usage), this need not be the case. Moreover, an additional resistance tubing, or a set of additional resistance tubings, made of a different grade of tubing to provide different tension, can be provided and used with exercise system 100. It is especially preferred, however, that the pair of first resistance tubings 11, the second and third resistance tubings 21 and 31, all have a length of approximately twenty to twenty four inches. Resistance tubings, and attachment mechanisms, are commonly available in the exercise industry from a number of manufacturers, one example of which is SPRI Products.

Figure 5:
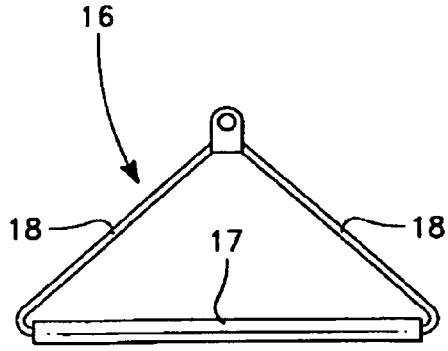
FIG. 5 is a top planar view of a grip useful in the preferred embodiment of the present invention.

A pair of triangular grips 16 is attachable to the second attachment mechanism 15 of the pair of resistance tubings 13. In an especially preferred embodiment, shown in FIG. 5, each of the pair of grips 16 be constructed of nylon handles on two of its sides 18 and have a canvas or foam grip handle 17 on the third side. The pair of grips 16 is constructed so that there is sufficient room within each triangular grip for a user's arm to be placed within the grip so that the grip is held at the user's elbow during certain exercises.

Figure 4:
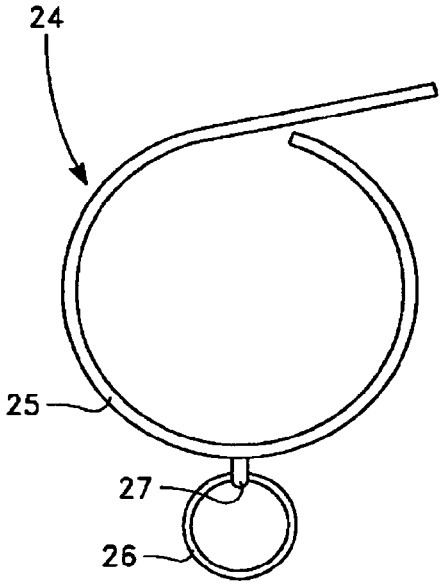
FIG. 4 is a top planar view of an attachable anklet bracelet useful in the preferred embodiment of the present invention.

A pair of attachable ankle bracelets 24 is attachable to the second attachment mechanisms of second and third resistance tubings 21 and 31. In an especially preferred embodiment, shown in FIG. 4, an ankle strap 25, closable with Velcro® or some other form of fasteners (not shown), has a steel loop 26 affixed to ankle strap 25 by eyelet 27. In this embodiment, the second attachment mechanisms affix themselves to the steel loop 26.

While the preferred embodiment has been described in detail, including descriptions of various dimensions and materials, it should be recognized that such descriptions merely describe a preferred embodiment of the invention and are not meant, unless otherwise stated, to be limiting. For example, while it is preferable that platform 1 be foldable, so that it can be stored more readily, or even so multiple units can be stacked on top of or along side one another in the same fashion as foldable tables, it need not be. Similarly, first, second and third pipes 11, 21 and 31 need not be detachable connected to platform 1, and there are many different methods by which "pipes" could be attached to platform 1.

Having now described a preferred embodiment of the physical elements that are part of an exercise system according to the present invention, it is time to turn some of the myriad of exercises that can be performed with such a system.

The present system is especially well adapted to perform a variety of basic exercises quickly and efficiently.

A first category of exercises can be performed by a user who is kneeling on exercise mat 7 facing toward first end 3. Exercises that can be performed with the pair of resistance tubings 13 with the user's hands in the pair of grips 16 moving back and forth will exercise muscles in the chest, the front deltoids, triceps, biceps, front and rear deltoids, abs, and the lower back. In other words, all of the core muscles found in the "powerhouse" that are exercised by Pilates movements can be exercised.

A second category of exercises can be performed by a user who now reverses direction from the last category of exercises and is kneeling on exercise mat 7 facing toward second end 5. In this position, exercises that can be performed with the pair or resistance tubings 13 with the user's hands in the pair of grips 16 moving back and forth will exercise muscles in the chest. Also, rear deltoid fly exercises, with crossover pulling, can be performed from this position.

A third category of exercises can be performed by a user who is now standing on exercise mat 7 facing toward first end 3. In this position, by once again using the pair or resistance tubings 13 with the user's hands in the pair of grips 16, the user can perform squat exercises, as well as all of the exercises that could be performed when kneeling.

A fourth category of exercises can be performed by a user who is on exercise mat 7 who would be facing toward first end 3 when kneeling but starts from lying on the back. In this position, once again using the pair or resistance tubings 13, the user can perform sit-ups (or crunches) moving forward toward first end 3 with the user's hands in the pair of grips 16 or with arms inserted into the triangular grips so they are held at the elbow. Moreover, an entirely new exercise can be performed from this position when the grips 16 are held at the elbows. In this position, with the user's back flat on mat 7, elbows are pointed out wide away from the shoulders and, as the sit-up is performed moving up into the crunch position, the elbows are brought inwardly toward the chest so that they point toward the user's knees on top of the chest; as the user performs the reverse portion of the sit-up, the reverse motion is also performed with respect to the elbows. This exercise will exercise the muscles from the lower abs all the way up to the chest, all in one movement.

A fifth category of exercises can be performed by a user who is laying flat on exercise mat 7, facing toward first end 3, with the pair of ankle bracelets 24 attached to the user's ankles and the second attachment mechanism of the pair of resistance tubings 13. In this position, exercises can be performed that will work the lower body muscles, such as various muscles in the legs. In addition, another totally new exercise can be performed from this position when the pair of grips 16 is attached to the second and third attachment devices 22 and 32 of the second and third pipes 21 and 31, the grip handles 17 being held in the user's hands. From this position, the exercise is performed by extending the arms out toward first end 3 (increasing the tension on second and third resistance tubings 22 and 32) while the legs extend down toward first end 3 (relaxing the tension on first pair of resistance tubings 11), and then bringing the arms back toward second end 5 (releasing the tension on second and third resistance tubings 22 and 32) while the legs extend back toward second end 5 (increasing the tension on first pair of resistance tubings 11). This exercise allows for use of opposing forces, which is believed to be unique.

A sixth category of exercises can be performed by a user who is lying on exercise mat 7 on the user's stomach facing toward second end 5 with second and third pipes 11 and 21 detached. From this position, using the pair of grips 16 attached to the pair of resistance tubings 13 attached to first pipe 13, the user can perform bench press types of exercises by pushing down. Also, from this position, the user can exercise muscles used in swimming by mimicking swimming strokes.

A seventh category of exercises can be performed by a user who is lying on the user's back on exercise mat 7 facing toward first end 3. In this position, using the pair of grips 16 attached to the pair of resistance tubings 13 attached to second and third pipes 21 and 31, the user can do shoulder presses as well as many other exercises, such as curls, and the lats can be used for control. This position can also be used by a person in a wheelchair because the person can lay on exercise mat 7 and do a variety of exercises.

An eighth category of exercises, which are believed to be unique, can be performed by a user in the same position as the seventh category of exercises, but also with ankle bracelets 24 attached to the pair of resistance tubings 13 attached to first pipe 11. From this position, leg exercises and shoulder press exercises can be done together concurrently, thus utilizing opposing forces.

As can be determined from the foregoing description of eight different categories of exercises that can be performed using the exercise system of the present invention, a wide variety of exercises, including some novel exercises, can be performed using the present invention.

The present invention allows for muscles to be worked in an isolated manner (separately) or allows for combination exercises (more than one group of muscles working simultaneously through the same motion). Due to dual yet opposing points of ballast (resistance), combination exercises can be performed in parallel planes of motion as well as opposing planes of motion. All muscles groups of the body can be worked in a specified sequential manner that allows for a total body conditioning exercise routine that focuses on strength, flexibility, balance and cardiovascular development simultaneously. Also, exercise routines can be performed with a minimum requirement of changes in equipment, and changes in tension can be made by changes of location of a user's body instead of the necessity of removing or changing resistance devices, such as springs. This also allows an individual user the ability for a more continuous, or custom-fit, level of resistance since the level of resistance is not dependent upon finite variations in resistance, such as changing the spring tension from one finite amount to another (with gaps in between), but upon variable levels of resistance controlled by body positioning.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. An exercise system, comprising:

a platform having a first end, a second end and a definable planar platform surface located between the first and second ends;

a pair of first and second resistance tubings, a third resistance tubing, and a fourth resistance tubing, each having a first attachment mechanism affixed at one end and a second attachment mechanism affixed at its other end;

a first pipe substantially centrally connected to the platform proximate to the first end that extends perpendicularly upwardly from the definable planar platform surface, the first pipe having a first attachment device located distant from the definable planar platform surface for enabling two first attachment mechanisms to be attached to the first pipe;

a second pipe connected to the platform proximate to the second end that extends perpendicularly upwardly from the definable planar platform surface, the second pipe having a second attachment device located distant from the definable planar platform surface for enabling one first attachment mechanism to be attached to the second pipe;

a third pipe connected to the platform proximate to the second end that extends perpendicularly upwardly from the definable planar platform surface, the third pipe having a third attachment device located distant from the definable planar platform surface for enabling one first attachment mechanism to be attached to the third pipe;

a pair of grips attachable to the second attachment mechanism of the pair of resistance tubings; and a pair of attachable ankle bracelets that are attachable to the second attachment mechanisms of the second and third resistance tubing;

wherein the second and third pipes are substantially equidistant from the second end; and wherein the second and third attachment devices are located substantially equidistant from the definable planar platform surface and the third attachment device is located farther from the definable planar platform surface than the second and third attachment devices.

2. The exercise system as recited in claim 1, further comprising:

an exercise mat attached to the definable planar platform surface between the first and second ends of the platform.

3. The exercise system as recited in claim 1, wherein the platform is comprised of a first foldable platform to which the first pipe is detachably connected and a second foldable platform to which the second and third pipes are detachably connected, the first and second foldable platforms forming the definable planar platform surface when they are not folded together relative to one another, the first and second foldable platforms being foldable substantially 180 degrees relative to each other.

4. The exercise system as recited in claim 3, further comprising:

a plurality of foldable leg supports that cause the platform to be raised off from a surface on which the exercise system is deployed when the legs are in an extended position and the first and second foldable platforms lie flat but which are foldable when the first and second foldable platforms are folded relative to each other.

5. The exercise system as recited in claim 1, wherein the first attachment device is located approximately four feet from the definable planar platform surface.

6. The exercise system as recited in claim 5, wherein the second and third attachment devices are located approximately six to twelve inches from the definable planar platform surface.

7. The exercise system as recited in claim 1, wherein the second and third attachment devices are located between approximately six to approximately twelve inches from the definable planar platform surface.

8. The exercise system as recited in claim 1, wherein the second and third pipes are at least approximately two feet apart from each other.

9. The exercise system as recited in claim 1, wherein the pair of first and second resistance tubings and the third and fourth resistance tubings have approximately the same resistance.

10. The exercise system as recited in claim 1, wherein the third and fourth resistance tubings have substantially the same resistance and said resistance is different than that of the pair of first and second resistance tubings.

11. A foldable exercise system, comprising:

a pair of first and second resistance tubings, a third resistance tubing and a fourth resistance tubing, each having a first attachment mechanism affixed at one end and a second attachment mechanism affixed at its other end;

a foldable, raised platform comprised of a first foldable platform having a first end and a second foldable platform having a second end, the first and second foldable platforms forming a substantially planar platform surface when they are not folded together relative to one another, the first and second foldable platforms being foldable substantially 180 degrees relative to each other;

an exercise mat attached to the planar platform surface between the first and second ends of the foldable platform, said exercise mat comprising a first mat attached to the first foldable platform and a second mat attached to the second foldable platform;

a plurality of foldable leg supports that cause the platform to be raised off from a surface on which the exercise system is deployed when the legs are in an extended position and the first and second foldable platforms lie flat but which are foldable when the first and second foldable platforms are folded relative to each other;

a first pipe detachably connectable to the first foldable platform proximate to the first end so as to extend perpendicularly upwardly from the planar platform surface, the first pipe having a first attachment device locatable approximately four feet from the planar platform surface for enabling the first attachment mechanism of the pair of first and second resistance tubings to be attached to the first pipe;

a second pipe detachably connectable to the second foldable platform proximate to the second end so as to extend perpendicularly upwardly from the planar platform surface, the second pipe having a second attachment device locatable approximately ten inches from the planar platform surface for enabling at least one first attachment mechanism to be attached to the second pipe;

a third pipe detachably connectable to the second foldable platform proximate to the second end so as to extend perpendicularly upwardly from the planar platform surface, the third pipe having a third attachment device locatable approximately ten inches from the planar platform surface for enabling at least one of the first attachment mechanisms to be attached to the third pipe;

a grip that is attachable to the second attachment mechanism of the first resistance tubing; and a pair of attachable ankle bracelets that are attachable to the second attachment mechanisms of the second and third resistance tubing;

wherein the third and fourth pipes are substantially equidistant from the second end when they are connected to the second foldable platform.

* * * * *